US010989499B2

(12) United States Patent
Connolly

(10) Patent No.: US 10,989,499 B2
(45) Date of Patent: Apr. 27, 2021

(54) COMPACT SIGHT ACCESSORY MECHANISM

(71) Applicant: RAYTHEON CANADA LTD.—ELCAN, Ottawa (CA)

(72) Inventor: John Maxwell Connolly, Penetanguishene (CA)

(73) Assignee: RAYTHEON CANADA LTD.—ELCAN, Ottawa (CA)

( * ) Notice: Subject to any disclaimer, the term of this patent is extended or adjusted under 35 U.S.C. 154(b) by 0 days.

(21) Appl. No.: 16/433,742

(22) Filed: Jun. 6, 2019

(65) Prior Publication Data

US 2020/0386523 A1 Dec. 10, 2020

(51) Int. Cl.

| | |
|---|---|
| ***F41G 1/00*** | (2006.01) |
| ***F41G 11/00*** | (2006.01) |
| ***F41G 1/17*** | (2006.01) |

(52) U.S. Cl.

CPC ..... *F41G 11/008* (2013.01); *F41G 1/17* (2013.01); *F41G 11/003* (2013.01)

(58) Field of Classification Search

CPC ..... F41G 1/00; F41G 11/005; F41G 11/007
See application file for complete search history.

(56) References Cited

U.S. PATENT DOCUMENTS

| | | | |
|---|---|---|---|
| 8,438,773 B2 | 5/2013 | Carlson et al. | |
| 8,935,875 B2 * | 1/2015 | Collin | F41G 11/003 42/90 |
| 9,417,034 B1 | 8/2016 | Swan | |
| 2006/0162227 A1 | 7/2006 | Samson | |
| 2011/0138673 A1 | 6/2011 | Deros | |
| 2011/0296732 A1 | 12/2011 | Carlson et al. | |
| 2013/0008072 A1 | 1/2013 | Chung | |
| 2013/0036650 A1 | 2/2013 | Larue | |
| 2013/0160345 A1 | 6/2013 | Li et al. | |
| 2018/0180386 A1 | 6/2018 | Keller et al. | |

FOREIGN PATENT DOCUMENTS

| | | |
|---|---|---|
| DE | 202018101992 U1 | 4/2018 |
| FR | 2865045 A1 | 7/2005 |

OTHER PUBLICATIONS

International Search Report and Written Opinion of International Patent Application No. PCT/IB2020/055668 dated Nov. 23, 2020.

* cited by examiner

*Primary Examiner* — J. Woodrow Eldred
(74) *Attorney, Agent, or Firm* — Lando & Anastasi, LLP

(57) ABSTRACT

A sight magnifier assembly is configured to be releasably secured to a rail feature of a firearm to be used with a sight assembly to enhance a downrange image. The sight magnifier assembly includes a base configured to be releasably secured to the rail feature of the firearm and a housing rotatably coupled to the base. The housing is configured to support sight optics used to enhance or improve the downrange image. The assembly further includes a mechanism configured to enable the rotation the housing with respect to the base between a use position in which the sight optics is configured to be used with the sight assembly and a stored position in which the sight optics is moved so that the housing and the sight magnifier assembly is nearly completely obscured from the operator by the sight assembly as viewed along a longitudinal axis.

8 Claims, 5 Drawing Sheets

COMPACT SIGHT ACCESSORY MECHANISM

GOVERNMENT RIGHTS

Not applicable.

BACKGROUND OF THE INVENTION

Embodiments of the present disclosure are generally directed to accessories that are used on weapons, such as sight magnifiers used on firearms, and more particularly to a sight magnifier mount assembly including a compact sight accessory mechanism configured to store a sight magnifier in an out-of-the-way position.

Firearms are frequently outfitted with accessories, such as scopes, electronic sights, magnifying devices, and night vision devices. These types of accessories are typically mounted on the firearm behind the primary aiming device associated with the firearm. With one type of accessory, the accessory is mounted on rails associated with the firearm in a traditional manner. In one embodiment, the accessory is designed to mount on a Picatinny or Pic rail, which is a military standard rail interface system for firearm accessories.

Prior sight magnifier devices are configured to move a sight magnifier outwardly to give the user an unobstructed view through the sighting device. With most sight magnifier devices, the movement of the sight magnifier introduces a large obstruction when observing the scene. Right- and left-handed application is managed typically by some level of disassembly and reassembly of symmetrical components. Another approach is to rotate the mounting interface and reattach the device.

FIG. 1 illustrates a sight magnifier device generally indicated at 10 mounted on a rail 11 of a firearm 12. As shown, the sight magnifier device 10 includes a mount 13 configured to mount the device on the rail 11 of the firearm 12 and a sight magnifier 14 rotatably movable between a use position (not shown) and an out-of-the-way position (shown). When the sight magnifier 14 is moved to the out-of-the-way position, the sight magnifier blocks the scene of the person using the firearm 12 with both eyes open, typically when using a unity sight. The flip out design is inherently a right-handed device usually requiring some alteration or compromise when the user is left-handed. In this position, the sight magnifier 14 also presents a snag hazard since the sight magnifier extends from a periphery of the firearm 12.

SUMMARY OF INVENTION

One aspect of the present disclosure is directed to a sight magnifier assembly configured to be releasably secured to a rail feature of a firearm. The sight magnifier assembly is configured to be used with a sight assembly to enhance and/or improve a downrange image as viewed through the sight assembly. In one embodiment, the sight magnifier assembly comprises a base configured to be releasably secured to the rail feature of the firearm, a housing rotatably coupled to the base, the housing being configured to support sight optics used to enhance or improve the downrange image, and a mechanism configured to enable the rotation the housing with respect to the base between a use position in which the sight optics is configured to be used with the sight assembly and a stored position in which the sight optics is moved so that the housing and the sight magnifier assembly is nearly completely obscured from the operator by the sight assembly as viewed along a longitudinal axis.

Embodiments of the sight magnifier assembly further may include configuring the base with two end supports configured to be releasably secured to the rail feature of the firearm. The housing may include a body portion, a sight magnifier portion configured to house sight optics to enhance or enlarge the image, and a support arm that extends from the body portion to connect the sight magnifier housing to the base. The sight magnifier portion and body portion may be coaxial and extend longitudinally along a common axis. The mechanism may include a rotation shaft configured to enable the rotation of the support arm with respect to the base of the sight magnifier assembly. The rotation shaft may extend through an elongate bore formed in the support arm, with ends of the rotation shaft being mounted within respective openings formed in the end supports of the base. The mechanism further may include bushings positioned between the rotation shaft and the support arm shaft to enable the rotation of the support arm with respect to the base, the bushings being disposed within bushing seats formed in the support arm. The mechanism further may include O-rings positioned at the ends of the rotation shaft to protect the bushings from contaminants and to stiffen any potential axial movement of the support arm with respect to the base, the O-rings being disposed within O-ring seats formed in the support arm, with the O-ring seats being positioned adjacent and outboard with respect to the bushing seats. The mechanism further may include a detent assembly configured to maintain the housing in the use position and in the stored position and to enable the movement of the housing between the use position and the stored position. The detent assembly may include at least one detent housed by the support arm, and a first feature and a second feature associated with one of the end supports of the base, the first feature being located to position the housing in the use position when the at least one detent is received by the first feature and the second feature being located to position the housing in the stored position when the at least one detent is received by the second feature. The sight magnifier assembly of claim 10, wherein the detent assembly further includes a compression spring configured to push the at least one detent outward to force the detent against the one end support. The support arm may include an elongate bore sized to house the at least one detent and the compression spring. The one end support may include a hardened insert having the two features. The mechanism further may include a hard stop over-travel feature.

Another aspect of the present disclosure is directed to an accessory configured to be releasably secured to a rail feature of a weapon. In one embodiment, the accessory comprises a base configured to be releasably secured to the rail feature of the weapon, the base including two end supports configured to be releasably secured to the rail feature, a housing rotatably coupled to the base, the housing including a body portion and a support arm that extends from the body portion to connect to the base, and a mechanism configured to enable the rotation the housing with respect to the base between a use position and a stored position. The mechanism includes a rotation shaft configured to enable the rotation of the support arm with respect to the base of the sight magnifier assembly, the rotation shaft extends through an elongate bore formed in the support arm, with ends of the rotation shaft being mounted within respective openings formed in the end supports of the base, and a detent assembly configured to maintain the housing in the use position and in the stored position and to enable the movement of the housing between the use position and the stored position.

Embodiments of the accessory further may include configuring the detent assembly to include at least one detent housed by the support arm, and a first feature and a second feature associated with one of the end supports of the base. The first feature is located to the position the housing in the use position when the at least one detent is received by the first feature and the second feature is located to position the housing in the stored position when the at least one detent is received by the second feature. The detent assembly further may include a compression spring configured to push the at least one detent outward to force the detent against the one end support. The one end support may include a hardened insert having the two features. The mechanism further may include bushings positioned between the rotation shaft and the support arm shaft to enable the rotation of the support arm with respect to the base, the bushings being disposed within bushing seats formed in the support arm. The mechanism further may include O-rings positioned at the ends of the rotation shaft to protect the bushings from contaminants and to stiffen any potential axial movement of the support arm with respect to the base, the O-rings being disposed within O-ring seats formed in the support arm, with the O-ring seats being positioned adjacent and outboard with respect to the bushing seats.

BRIEF DESCRIPTION OF THE DRAWINGS

Various aspects of at least one embodiment are discussed below with reference to the accompanying figures, which are not intended to be drawn to scale. Where technical features in the figures, detailed description or any claim are followed by references signs, the reference signs have been included for the sole purpose of increasing the intelligibility of the figures, detailed description, and claims. Accordingly, neither the reference signs nor their absence are intended to have any limiting effect on the scope of any claim elements. In the figures, each identical or nearly identical component that is illustrated in various figures is represented by a like numeral. For purposes of clarity, not every component may be labeled in every figure. The figures are provided for the purposes of illustration and explanation and are not intended as a definition of the limits of the invention. In the figures:

DETAILED DESCRIPTION OF THE INVENTION

Figure 1:
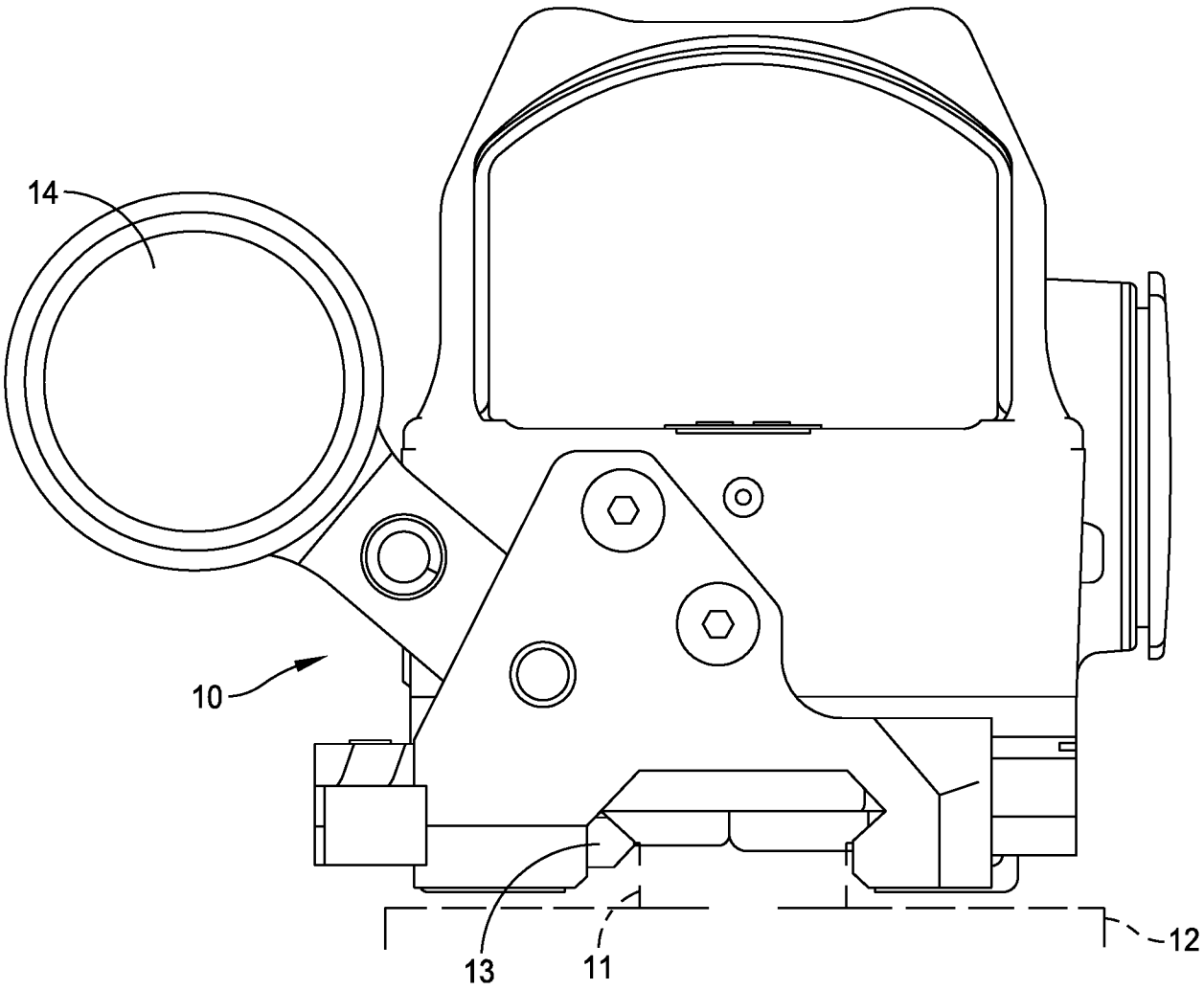
FIG. 1 is an end view of a sight magnifier device of a prior art design that is configured to be mounted on a weapon.

Embodiments of the present disclosure are directed to accessories configured to mount on a firearm. Accessories include, but are not limited to, scopes, iron sights, tactical lights, laser aiming modules, night vision devices, reflex sights, foregrips, bipods, slings and bayonets.

Currently accessory magnifiers and similar optical devices are used to enhance the user's ability to observe and engage targets at distances that unmagnified sights could not otherwise be used. These devices introduce issues associated to their use. For example, the magnifiers cause an obstruction to the scene and adversely affect situational awareness in their stored position. The magnifiers can become a snag hazard when they are in their stored position since they extend beyond a periphery of the accessory and the object on which the accessory is mounted, e.g., the firearm. Typical accessories require mechanical changes or compromises by the user to be capable of ambidextrous use. The accessory can introduce an additional forward optical signature when in their stored position which could impact concealment efforts.

Embodiments of the present disclosure are directed to a compact sight accessory mechanism for a sight magnifier device that uses the space already occupied by a mounting interface to enable the rotation of a sight magnifier to a stored position to not to create an obstruction of the scene. The sight magnifier does not have any significant footprint beyond the profile of the sight magnifier device to avoid obstructing the scene and creating a snag hazard. The mechanism secures the sight magnifier to a rail of the weapon or similar interface, and the body of the sight magnifier is able to rotate on a shaft toward the weapon. The sight magnifier is capable of rotating inward and downward toward the mounting rail with an attachment arm of the magnifier body folding nearly flat between the end supports of the base. This rotation feature controls the movement between deployed and storage positions for rapid switching into and out of the optical path. A rotation joint of the mechanism has O-rings at each end that protect bushings from contaminants and stiffen the mechanics axially.

In one embodiment, the sight magnifier is located and held in position by two steel balls located in a bore in a body of the mechanism of the sight magnifier device. The steel balls, or detents, are loaded axially by a compression spring that acts to push the balls outward in the bore so that they are forced into a conical or similar feature in a hardened insert. A hard stop over-travel feature enables the body of the mechanism to be aggressively cycled into position with the ball/detent correcting and holding the magnifier in position accurately when the body is released. The operation of the mechanics to move the sight magnifier can be done with either hand. In the stored position, the sight magnifier is shielded by the sight mounted in front of it so that the optics of the sight magnifier do not contribute to the user's forward signature and the sight magnifier is less exposed environmentally.

The compact, snag-free stored position makes maneuvering through entanglements, climbing with the weapon, and storage of the weapon in tight spaces much easier. With embodiments of the present disclosure, the sight magnifier, when stored, is in a more protected position on the weapon.

Traditionally, with "flipped out" designs, as illustrated in FIG. 1, the device is more susceptible to damage because it extends beyond the natural profile of the weapon. The optics of the sight magnifier are also more exposed to blowing debris in a "flipped" out design. Having the sight magnifier flip in or down to be stored behind the sight prevents an additional forward signature when concealment is a consideration.

Also, the phraseology and terminology used herein is for the purpose of description and should not be regarded as limiting. Any references to embodiments or elements or acts of the systems and methods herein referred to in the singular may also embrace embodiments including a plurality of these elements, and any references in plural to any embodiment or element or act herein may also embrace embodiments including only a single element. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

Referring to the drawings, and more particularly to FIGS. 2A and 2B and FIGS. 3A and 3B, a portion of a firearm 12 having a rail feature 11, such as a Picatinny rail, is shown with a sight assembly generally indicated at 20 mounted on the rail. The sight assembly 20 is provided to enable the operator of the firearm 12 to sight and target objects downrange along a longitudinal axis associated with the firearm. The firearm 12 can be any type of firearm configured to receive sight assemblies, such as an M16 rifle. To enhance or enlarge the sight image, a sight magnifier assembly, generally indicated at 30, is mounted on the rail 11 of the firearm 12 in front of the sight assembly 20. The sight magnifier assembly 30 is designed to operate with the sight assembly 20 to enable the operator to better view images downrange.

Figure 4:
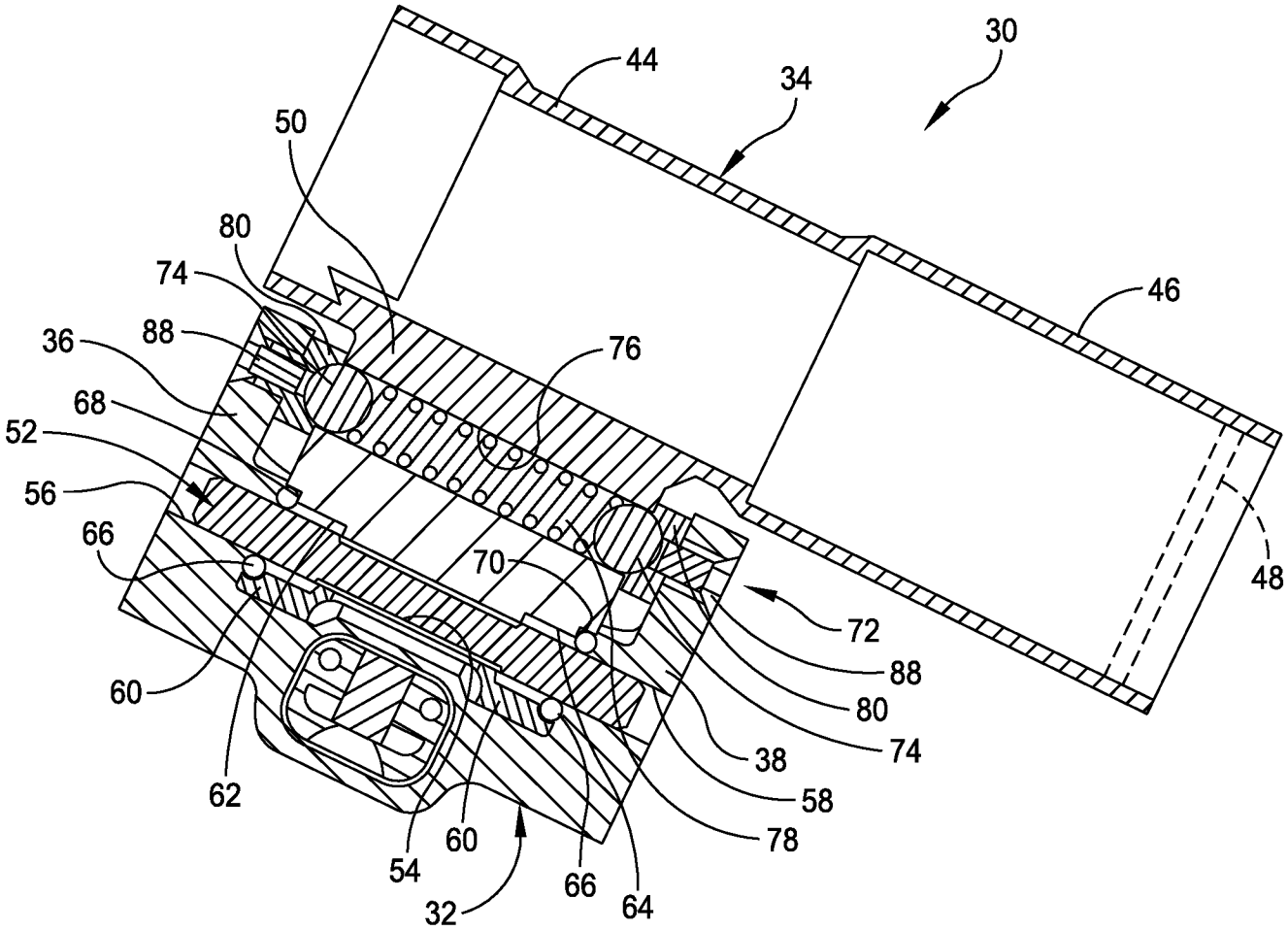
FIG. 4 is a cross-sectional view of the compact sight accessory mechanism.

In one embodiment, the sight magnifier assembly 30 includes a base generally indicated at 32 and a sight magnifier housing generally indicated at 34. In the shown embodiment, the base 32 is mounted on the rail 11 of the firearm 12 and the sight magnifier housing 34 is rotatably coupled to the base. In one embodiment, the base 32 includes two end supports 36, 38, a retention member 40, and a retention screw 42 to secure the sight magnifier assembly 30 to the rail 11 of the firearm 12 in the well-known manner. In the shown embodiment, the end supports 36, 38 of the base 32 are coupled to one another by a cross structure, which is best illustrated in FIG. 4. However, the end supports 36, 38 of the base may be separate from one another. The sight magnifier housing 32 includes a body portion 44, a sight magnifier portion 46 configured to house sight optics 48 to enhance or enlarge the image, and a support arm 50 that extends from the body portion to connect the sight magnifier housing 34 to the base. As shown, the sight magnifier portion 46 and the body portion 44 are coaxial and extend longitudinally along a common axis. The support arm 50 is rotatably coupled to the base 32 of the sight magnifier assembly 30 by a rotation shaft, which will be described in greater detail below. In one embodiment, the base 32 and the sight magnifier housing 34 are fabricated from strong, lightweight materials. For example, the base 32 and the housing 34 may be made of cast aluminum or 6061 aluminum.

Figure 2B:
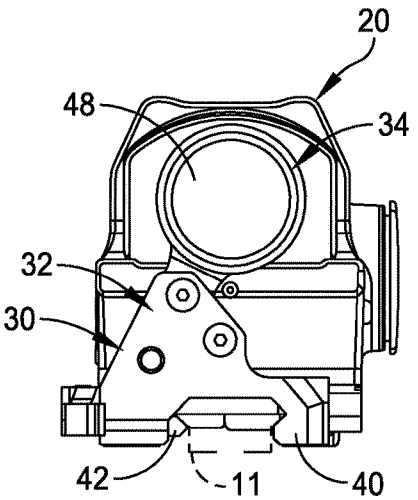
FIG. 2B is an end view of the sight magnifier device shown in FIG. 2A.
Figure 3B:
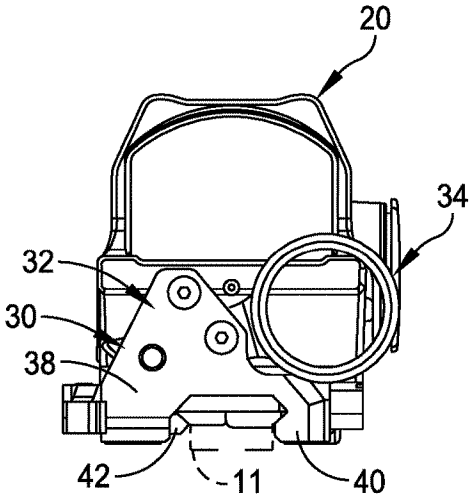
FIG. 3B is an end view of the sight magnifier device shown in FIG. 3A.
Figure 2A:
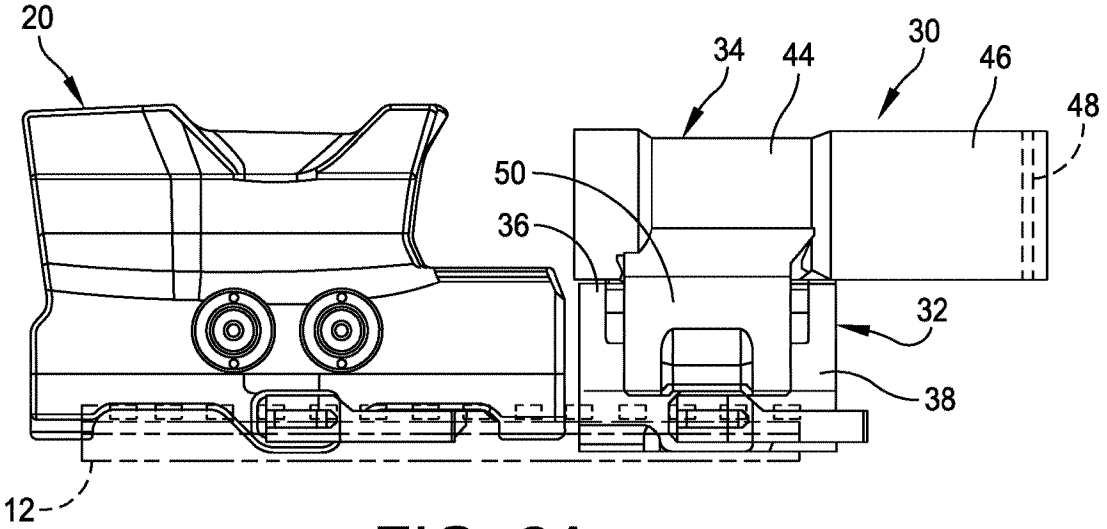
FIG. 2A is a side view of a sight magnifier device having a compact sight accessory mechanism of an embodiment of the present disclosure, a sight magnifier being shown in a deployed position.
Figure 3A:
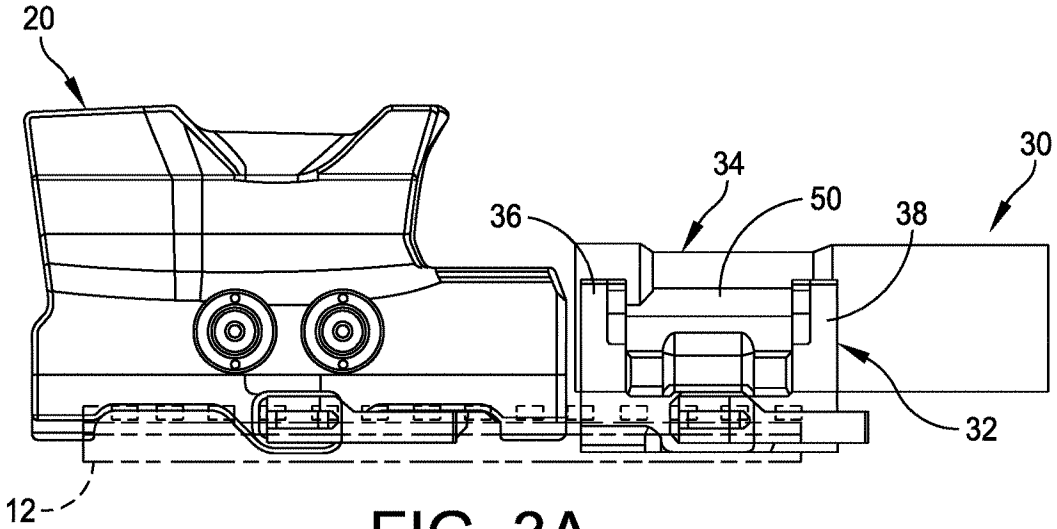
FIG. 3A is a side view of the sight magnifier device showing the sight magnifier in a stored position.

FIGS. 2A and 2B illustrate sight magnifier housing 34 of the sight magnifier assembly 30 in a deployed or use position in which the sight magnifier portion 46 is aligned and coaxial with optics of the sight assembly 20. In this position, the sight optics 48 of the sight magnifier assembly 30 enhances or enlarges the downrange image as seen through the sight assembly 20. FIGS. 3A and 3B illustrate the sight magnifier housing 34 of the sight magnifier assembly 30 in a stored position to remove the sight magnifier housing from the downrange view thereby avoiding the creation of an obstruction of the scene. When moving the sight magnifier housing 34 to the stored position, the sight magnifier housing rotates inward and downward toward the mounting rail 11 with the support arm 50 of the sight magnifier housing folding nearly flat between the end supports 36, 38 of the base 32. This rotation feature of the sight magnifier assembly 30 controls the movement of the sight magnifier housing 34 between deployed and storage positions for rapid switching into and out of the optical path.

Referring to FIG. 4, the sight magnifier assembly 30 includes a mechanism that enables the rotation of the sight magnifier housing 34 and its associated optics 48 supported by the sight magnifier portion 46 between the use and stored positions. As shown, the support arm 50 of the sight magnifier housing 34 is secured to the end supports 36, 38 of the base 32 by way of a rotation shaft 52 that enables the sight magnifier housing 34 to rotate or pivot with respect to the base 32. The rotation shaft 52 extends through an elongate bore 54 formed in the support arm 50, with ends of the rotation shaft being mounted within respective openings 56, 58 formed in the end supports 36, 38 of the base, respectively. Bushings, each indicated at 60, are provided between the rotation shaft 52 and the support arm 50 to enable the smooth rotation of the support arm with respect to the base 32. The bushings 60 are disposed within bushing seats 62, 64 formed in the support arm 50. O-rings, each indicated at 66, are further provided at the ends of the rotation shaft 52 to protect the bushings 60 from contaminants and to stiffen any potential axial movement of the support arm 50 with respect to the base 32. The O-rings 66 are disposed within O-ring seats 68, 70 formed in the support arm 50, with the O-ring seats being positioned adjacent and outboard with respect to the bushing seats 62, 64, respectively.

Figure 5:
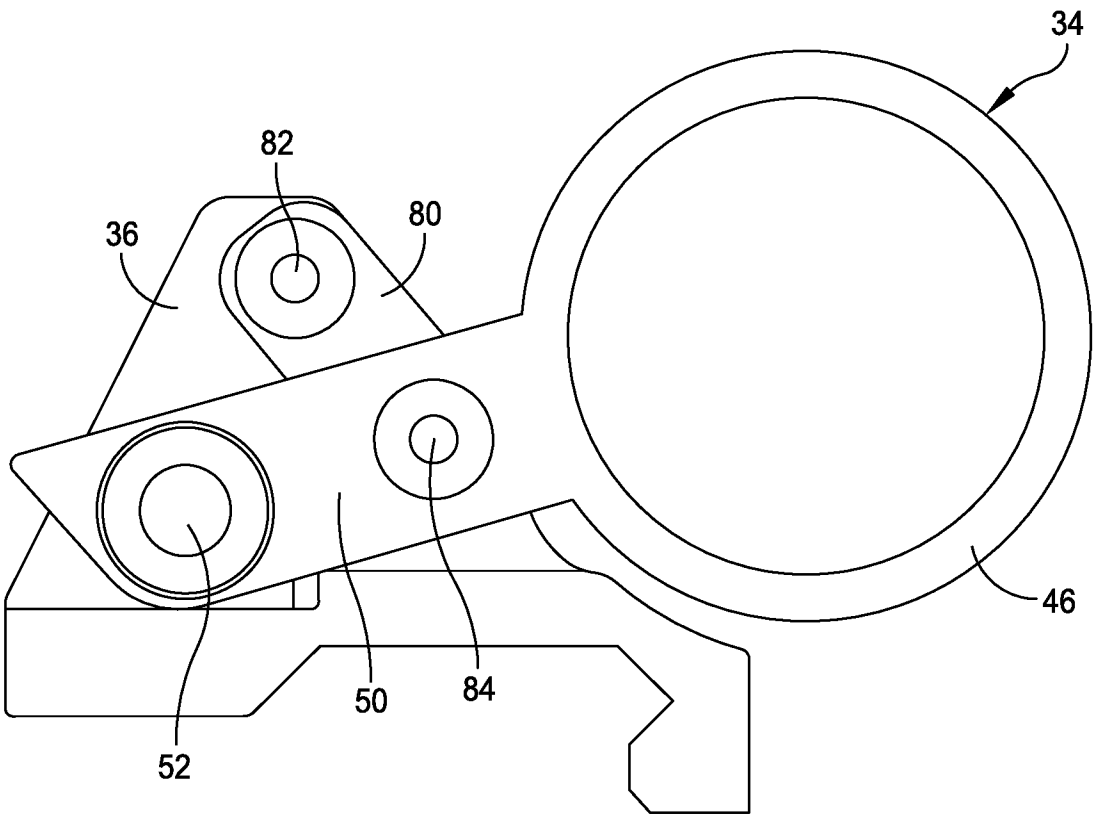
FIG. 5 is an end view of the compact sight accessory mechanism with portions removed to reveal interior components of the mechanism.

Referring additionally to FIG. 5, in the shown embodiment, the mechanism is configured to releasably maintain the sight magnifier housing 34 in the use position and in the stored position by way of a detent assembly, generally indicated at 72. In one embodiment, the sight magnifier housing 34 is located and held in position by the detent assembly 72, which has two steel balls or detents, each indicated at 74, positioned in another elongate bore 76 formed in the support arm 50 of the sight magnifier housing. The elongate bore 76 used to house the detents 75 extends along an axis that is parallel to an axis of the elongate bore 54 used to house the rotation shaft 52. The detents 74 are loaded axially by a compression spring 78 that acts to push the detents outward in the elongate bore 76 so that detents are forced against respective end supports 36, 38. Specifically, each end support 36, 38 includes a hardened insert 80 having two spaced apart conical or similar features 82, 84 formed in the insert. The features 82, 84 function as seats to receive the detents 74 when the detents are moved via the sight magnifier housing over a respective feature.

The inserts 80 are aligned with one another so that the detents 74 engage aligned conical features 82 or 84 when in the use and stored positions, respectively. Each detent 74 is configured to be received within one of the conical features 82, 84 to secure the sight magnifier housing 34 in place. One conical feature, e.g., conical feature 82 in FIG. 5, for each insert 80 is positioned to locate the sight magnifier portion 46 in the use position and the other conical feature, e.g., conical feature 84 in FIG. 5, for each insert is positioned to locate the sight magnifier portion in the stored position. FIG. 5 illustrates one end support, e.g., end support 36 of the base 32 and the sight magnifier housing 34 showing the insert 80 having the two spaced apart conical features 82, 84. The other end support 38 is a mirror image of end support 36, and includes the insert 80 having the two spaced apart conical features 82, 84. The spacing of the conical features 82, 84 define the distance that the sight magnifier housing 34 moves between the use and stored positions. Screws, each indicated at 88, are provided to secure the hardened inserts 80 of the detent assembly 72 in place.

Figure 7:
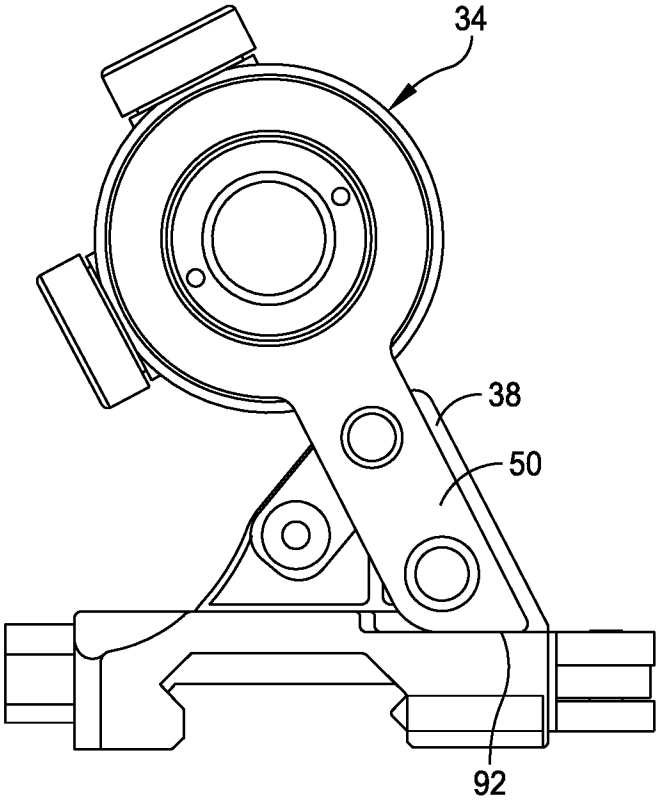
FIG. 7 is an end view of the compact sight accessory mechanism with portions removed to reveal a second hard stop feature.
Figure 6:
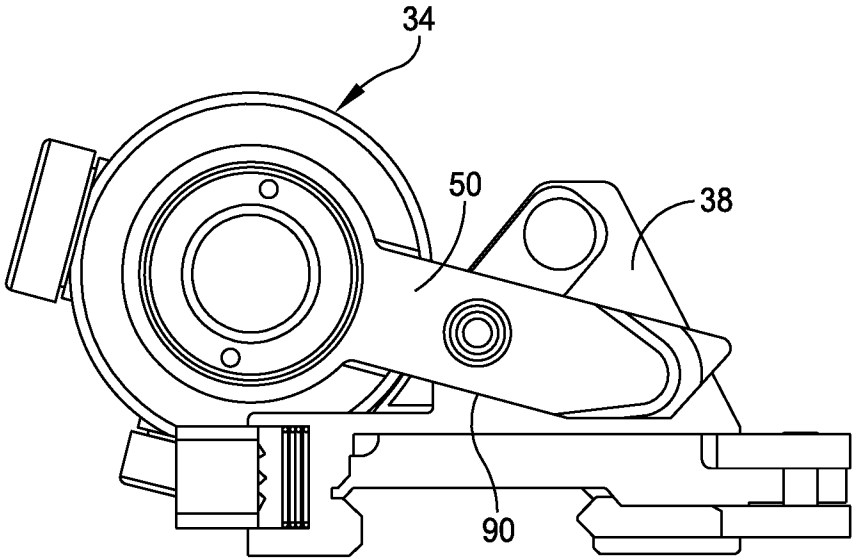
FIG. 6 is an end view of the compact sight accessory mechanism with portions removed to reveal a first hard stop feature.

Referring to FIGS. 6 and 7, in one embodiment, first and second hard stop over-travel features 90, 92 enable the support arm 50 of the sight magnifier housing 34 to be aggressively cycled into position with the detents 74 correcting and holding the sight magnifier portion 46 in position accurately when the body is released. FIG. 6 illustrates the sight magnifier housing 34 in the stored position. As shown, the support arm 50 of the sight magnifier housing 34 engages a first hard stop feature 90 to limit the movement of the sight magnifier housing. FIG. 7 illustrates the sight magnifier housing 34 in the use position. As shown, an end of the support arm 50 of the sight magnifier housing 34 engages a second hard stop feature 92 to limit the movement of the sight magnifier housing.

Referring back to FIGS. 2B and 3B, it is observed that the sight magnifier portion 46 including the sight optics 48 is directly in front of the sight assembly 20 when in the use position as shown in FIG. 2B. In this position, the operator of the firearm 12 is able to use the sight optics 48 provided in the sight magnifier portion 46 to enhance and/or enlarge the downrange image. When the operator desires to not utilize the sight optics 48 of the sight magnifier portion 46, the operator moves the sight magnifier portion to the stored position shown FIG. 3B by rotating the sight magnifier housing 34 in a clockwise direction. As shown, in the stored position, the sight magnifier assembly 30 is nearly completely obscured from the operator by the sight assembly 20, thereby enabling complete vision of the downrange scene by the operator. In addition, the sight magnifier housing 34, including the sight magnifier portion 46, is in a compact configuration to prevent snagging of the sight magnifier portion when the firearm 12 is carried by the operator. The length and travel of the sight magnifier portion 46 between the use and stored position can be varied by varying the distance of the spaced apart conical features 82, 84, which depends in part on the size of the sight magnifier assembly 30.

The strength in which the sight magnifier housing 34 is secured in the use position or the stored position is determined in part by the strength of the compression spring 78. The strength can also be effected by the depth of the conical features 82, 84. As described, the detents 74 are loaded axially by the compression spring 78 to push the detents outward against the insert 80. When the detents 74 reach their respective conical features 82, 84, the compression spring 78 moves the detents axially to seat the detents within their respective conical features 82 or 84. The depth of each conical feature 82, 84 is sufficiently deep to receive the detent 74 and properly seat the detent in place and sufficiently shallow to enable the detent to move laterally with respect to the insert 80 when a force is applied to sight magnifier housing 34 to rotate the housing to either its use position or its stored position. In one embodiment, the strength of the compression spring 78 and the depths of the conical features 82, 84 determine the amount of force required to move the sight magnifier housing 34.

Embodiments of the compact sight accessory mechanism man include other geometries to locate the magnifier body. For example, the magnifier body may include a male/female vee, which would require a clocking feature, such as a flat with a key or the like. The magnifier body may be configured to employ a straight pin for a cylindrical locating lock to control location this would require a feature to retract the pin against the spring pressure. These locating/locking concepts, including a ball/detent method, can be optionally single ended (i.e., a single ball/detent on only one end of the magnifier body and end support). In addition, the detents can be associated with the end supports and the cavity features can be associated with the support arm of the sight magnifier housing.

As used herein, the word "front" or "forward" corresponds to the direction of the sight magnifier assembly, "rear" or "rearward" or "back" corresponds to the direction opposite the direction of the sight magnifier assembly, "longitudinal" means the direction along or parallel to the longitudinal axis of the base, and "transverse" means a direction perpendicular to the longitudinal direction.

Having thus described several aspects of at least one embodiment, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A sight magnifier assembly configured to be releasably secured to a rail feature of a firearm, the sight magnifier assembly being configured to be used with a sight assembly, the sight magnifier assembly comprising:

a base configured to be releasably secured to the rail feature of the firearm, the base including a first end support and a second end support configured to be releasably secured to the rail feature of the firearm;

a housing rotatably coupled to the base, the housing being configured to support sight optics, the housing including a body portion, a sight magnifier portion configured to house sight optics, and a support arm that extends from the body portion to connect the sight magnifier housing to the base; and a mechanism configured to enable of the rotation the housing with respect to the base between a use position in which the sight optics is configured to be used with the sight assembly and a stored position in which the sight optics is moved so that the housing and the sight magnifier assembly is nearly completely obscured from the operator by the sight assembly, the mechanism including a rotation shaft configured to enable the rotation of the support arm with respect to the base of the sight magnifier assembly, the rotation shaft extending through an elongate bore formed in the support arm, with ends of the rotation shaft being mounted within respective openings formed in the first end support and the second end support of the base, and a detent assembly configured to maintain the housing in the use position and in the stored position and to enable the movement of the housing between the use position and the stored position, the detent assembly including a first detent housed by the first support arm and a second detent housed by the second support arm, and a first feature and a second feature associated with the first end support and a third feature and a fourth feature associated with the second end support, the first feature and the third feature being located to position the housing in the use position when the first detent and the second detent are received by the first feature and the third feature, respectively, and the second feature and the fourth feature being located to position the housing in the stored position when the first detent and the second detent are received by the second feature and the fourth feature, respectively.

2. The sight magnifier assembly of claim 1, wherein the sight magnifier portion and body portion are coaxial and extend longitudinally along a common axis.

3. The sight magnifier assembly of claim 1, wherein the mechanism further includes bushings positioned between the rotation shaft and the support arm shaft to enable the rotation of the support arm with respect to the base, the bushings being disposed within bushing seats formed in the support arm.

4. The sight magnifier assembly of claim 3, wherein the mechanism further includes O-rings positioned at the ends of the rotation shaft to protect the bushings from contaminants and to stiffen any potential axial movement of the support arm with respect to the base, the O-rings being disposed within O-ring seats formed in the support arm, with the O-ring seats being positioned adjacent and outboard with respect to the bushing seats.

5. The sight magnifier assembly of claim 1, wherein the detent assembly further includes a first compression spring configured to push the first detent outward to force the first detent against the first end support and a second compression spring configured to push the second detent outward to force the second detent against the second end support.

6. The sight magnifier assembly of claim 5, wherein the first support arm includes first elongate bore sized to house the first detent and the first compression spring and the second support arm includes a second elongate bore sized to house the second detent and the second compression spring.

7. The sight magnifier assembly of claim 5, wherein the first end support includes a first hardened insert having the first feature and a second hardened insert having the second feature, and the second end support includes a third hardened insert having the third feature and a fourth hardened insert having the fourth feature, and the second.

8. The sight magnifier assembly of claim 7, wherein the support arm of the mechanism further includes a hard stop over-travel feature to limit the movement of the housing with respect to the base.

* * * * *